US005548312A

United States Patent [19]

Asai

[11] Patent Number: 5,548,312

[45] Date of Patent: Aug. 20, 1996

[54] INK JET RECORDING METHOD

[75] Inventor: Akira Asai, Atsugi, Japan

[73] Assignee: Canon Kabusihiki Kaisha, Tokyo, Japan

[21] Appl. No.: 303,000

[22] Filed: Sep. 12, 1994

Related U.S. Application Data

[63] Continuation of Ser. No. 733,014, Jul. 19, 1991, abandoned, which is a continuation of Ser. No. 652,208, Feb. 5, 1991, abandoned, which is a continuation of Ser. No. 500,099, Mar. 21, 1990, abandoned, which is a continuation of Ser. No. 367,197, Jun. 15, 1989, abandoned.

[30] Foreign Application Priority Data

Jun. 20, 1988 [JP] Japan ..... 150000

[51] Int. Cl.[6] ..... B41V 2/05

[52] U.S. Cl. ..... 347/56; 347/62

[58] Field of Search ..... 347/62, 61, 57, 347/56

[56] References Cited

U.S. PATENT DOCUMENTS

| | | | |
|---|---|---|---|
| 3,582,954 | 6/1971 | Skala | 347/52 |
| 4,410,899 | 10/1983 | Haruta | 347/56 |
| 4,502,054 | 2/1985 | Brescia | 347/55 |
| 4,503,444 | 3/1985 | Tacklind | 347/15 |
| 4,580,148 | 4/1986 | Domoto | 347/56 |
| 4,580,149 | 4/1986 | Domoto | 347/61 |
| 4,593,291 | 6/1986 | Howkins | 347/68 |
| 4,723,129 | 2/1988 | Endo | 347/56 |

FOREIGN PATENT DOCUMENTS

| | | |
|---|---|---|
| 159188 | 10/1985 | European Pat. Off. . |
| 0159188 | 10/1985 | European Pat. Off. . |

*Primary Examiner*—Joseph W. Hartary

*Attorney, Agent, or Firm*—Fitzpatrick, Cella, Harper & Scinto

[57] ABSTRACT

In an ink jet recording method an electrical signal is input to an electro-thermal converting member to cause the heat generation of the electro-thermal converting member to thereby create a bubble in ink liquid, an ink droplet is discharged by the pressure when the bubble contracts and expands again after the expansion of the bubble has reached a maximum, and the discharged ink droplet is shot on a recording medium to thereby accomplish recording.

39 Claims, 3 Drawing Sheets

INK JET RECORDING METHOD

This application is a continuation of application Ser. No. 07/733,014 filed Jul. 19, 1991, which was a continuation of application Ser. No. 07/652,208 filed Feb. 5, 1991, which was a continuation of application Ser. No. 07/500,099 filed Mar. 21, 1990, which was a continuation of application Ser. No. 07/367,197 filed Jun. 15, 1989, all now abandoned.

BACKGROUND OF THE INVENTION

1. Field of the Invention

This invention relates to an ink jet recording method whereby flying ink droplets are formed by the utilization of the pressure of a bubble created by the heating of an electro-thermal converting member and the ink droplets are caused to adhere to a recording medium, thereby accomplishing recording of images or the like.

2. Related Background Art

As an ink jet recording method of this type utilizing heat energy, there is known a method as shown in Japanese Laid-Open Patent Application No. 56-139970 and U.S. Pat. No. 4,723,129 wherein utilization is made of pressure generated when a bubble is created, or a method as shown in U.S. Pat. No. 4,580,149 wherein utilization is made of a microjet created when a bubble created collapses.

However, in the above-described methods according to the prior art, the size of ink droplet discharged becomes equal to or a fraction of the volume of the expanded bubble, and this has been a hindrance in forming a minute ink droplet necessary to accomplish a highly dense record comprised of minute picture elements.

So, as a method for reducing the size of ink droplet discharged, it is within contemplation to make the heat generating portion small or to use a very small orifice or nozzle to discharge ink, but in any case, from limits in manufacturing techniques, it has been difficult to form minute ink droplets smaller than a certain size.

SUMMARY OF THE INVENTION

Thus, it is an object of the present invention to solve the above-noted problem peculiar to the prior art and to provide an ink jet recording method which can form minute ink droplets without making a recording head itself too small.

It is a further object of the present invention to propose an ink jet recording method in which ink discharge is effected by the utilization of the pressure when a bubble reaches a maximum volume and thereafter contracts and then expands again, whereby ink discharge in which the movement of ink liquid is small becomes possible.

It is also an object of the present invention to propose an ink jet recording method in which a bubble is created in ink liquid by inputting an electrical signal to an electro-thermal converting member to thereby cause the heat generation of the electro-thermal converting member and instead of the ink discharge by the expansion of said bubble or the recording by said discharge, an ink droplet is discharged by the pressure when said bubble contracts and re-expands after the expansion of said bubble has reached a maximum, and the discharged ink droplet is shot on a recording medium to thereby accomplish recording.

DESCRIPTION OF THE PREFERRED EMBODIMENTS

Figure 1A:
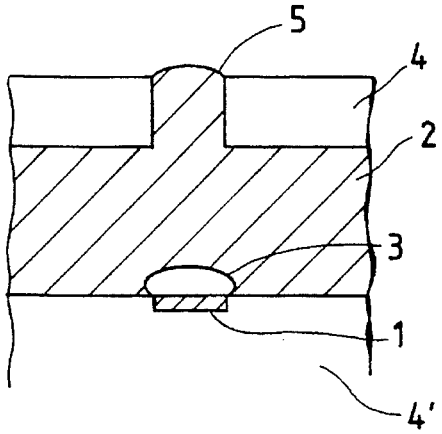
FIGS. 1A to 1D are cross-sectional views of a recording head according to an embodiment of the present invention.

The present invention will hereinafter be described in detail with respect to embodiments thereof shown in the drawings.

FIGS. 1A to 1D show embodiments of the present invention. In FIGS. 1A to 1D which show a cross-section of an ink jet recording head, the reference numeral 1 designates an electro-thermal converting member, the reference numeral 2 denotes ink liquid, the reference numeral 3 designates a bubble, the reference numeral 4 denotes a discharge port plate, the reference numeral 4' designates a base plate, and the reference numeral 5 denotes a discharge port or opening provided at a side of an ink liquid chamber exactly opposite the electro-thermal converting member. The ink liquid chamber formed by the discharge port plate 4 and the base plate 4' is filled with the ink liquid 2, and the bubble 3 is created in the ink liquid 2 by the electro-thermal converting member 1, whereby a minute ink droplet 6 may be caused to fly from the discharge port 5 formed in the discharge port plate 4.

As shown in FIG. 1A, when an electrical pulse signal is input to the electro-thermal converting member 1, the electro-thermal converting member 1 is heated and the bubble 3 is created in the ink liquid 2, and the bubble 3 begins to expand and reaches its maximum volume. At this time, the ink liquid 2 is about to be discharged from the discharge port 5, but is not discharged because the fluidics impedance, determined by a factor such as surface tension and described later, is great. In the ink jet recording head according to the prior art, an ink droplet is discharged at this time.

Figure 1B:
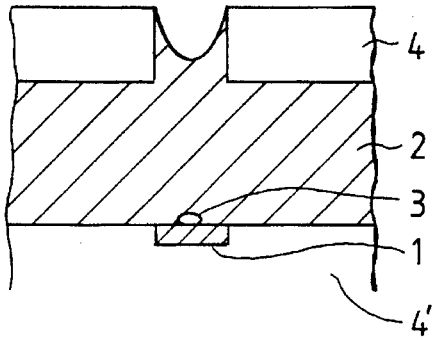

Next, as shown in FIG. 1B, the bubble 3 contracts suddenly because the temperature of the ink liquid 2 around the bubble 3 has become cold, and as a result, the meniscus of the discharge port 5 retracts.

With the sudden contraction of the bubble 3, a so-called cavitation rebound phenomenon occurs. That is, when the bubble 3 contracts suddenly, the condensation of the gas in the bubble becomes of no use and the gas in the bubble suddenly becomes high in pressure. Thereby, the bubble 3 is re-expanded as shown in FIG. 1C and creates a shock wave, which causes a projection to be produced in the meniscus of the discharge port 5.

Figure 1C:
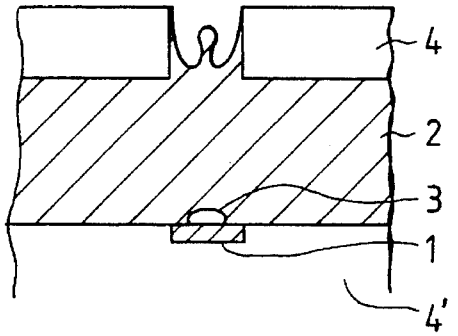
Figure 1D:
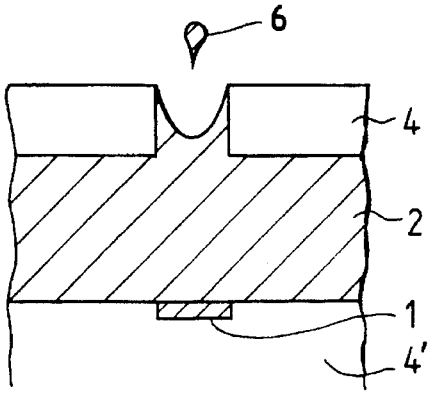

The projection produced in the meniscus flies as a minute ink droplet 6 smaller than the ink droplet in the prior art, as shown in FIG. 1C, and adheres to a recording medium and provides a picture element for forming a character or an image, while the bubble 3 disappears.

The ink droplet discharge by the above-described shock wave, unlike the conventional ink droplet discharge utilizing a bubble or microjet, can transmit pressure as a sound wave to the meniscus without moving a great deal of ink liquid and thus, it becomes possible to discharge a small amount of ink liquid at a high speed.

Figure 2A:
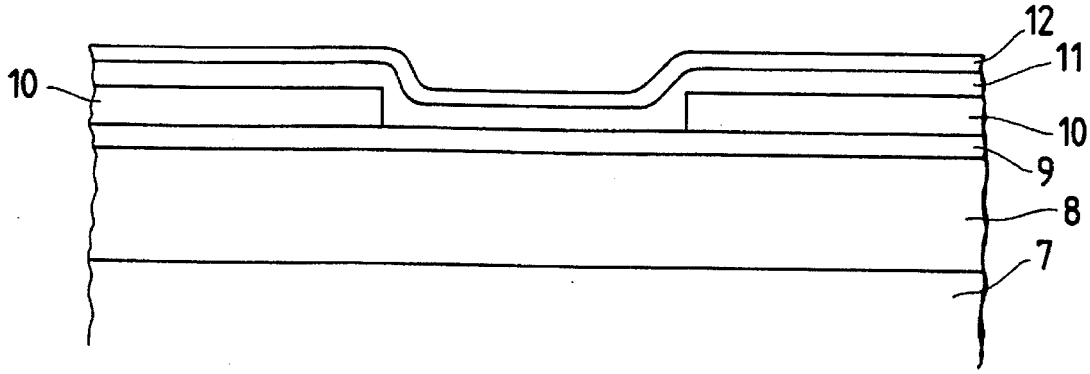
FIGS. 2A and 2B are a side view and a top plan view, respectively, showing the details of an electro-thermal converting member shown in FIG. 1.
Figure 2B:
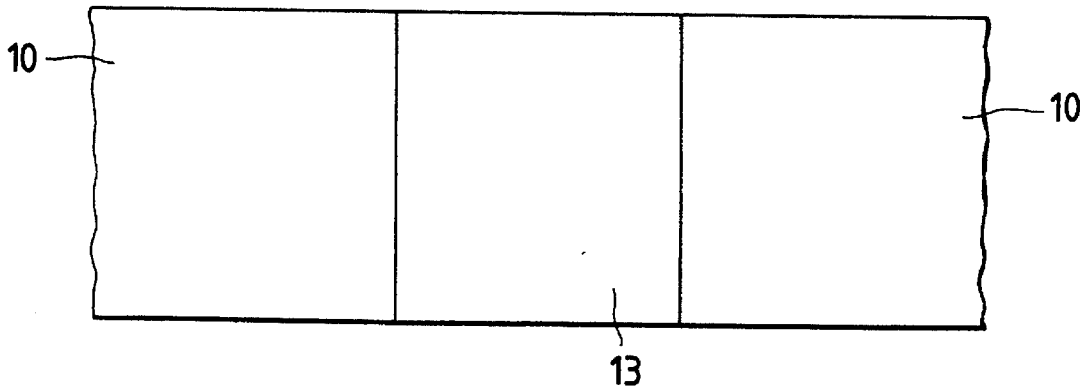
Figure 3A:
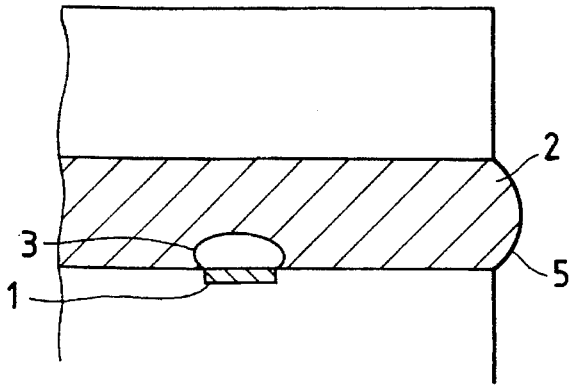
FIGS. 3A to 3D are cross-sectional views of a recording head according to another embodiment of the present invention.
Figure 3B:
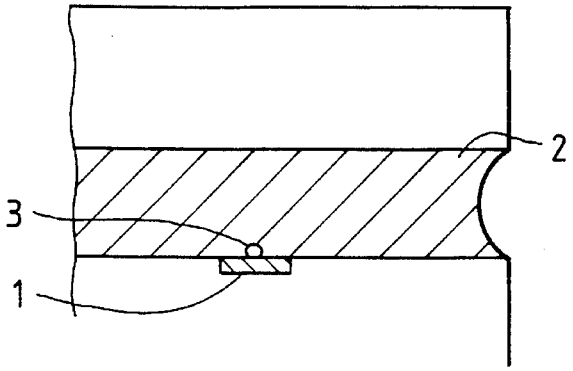
Figure 3C:
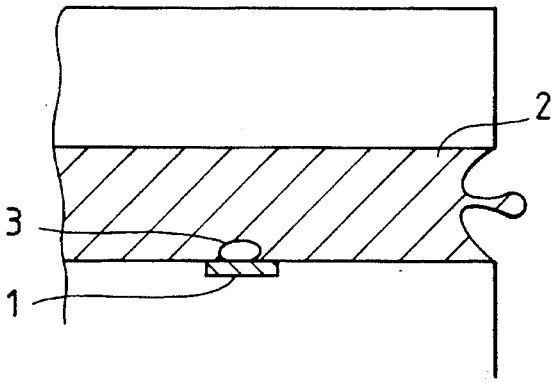
Figure 3D:
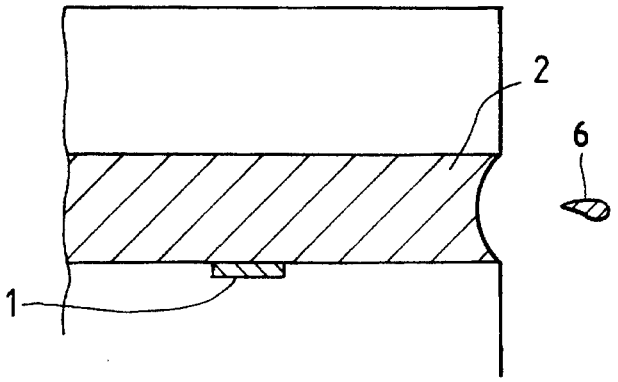

FIGS. 2A and 2B are a side view and a top plan view, respectively, showing the details of the electro-thermal converting member shown in FIG. 1. A surface oxidized layer ($SiO_2$) 8 having a thickness of 3 μm is formed on the upper surface of a silicon substrate 7 having a thickness of 0.5 mm by a heat treatment, and a resistor layer ($HfB_2$) 9 having a thickness of 0.13 μm is formed on the upper surface of the surface oxidized layer 8 by sputtering.

A portion of the resistor layer 9 is removed by etching, and on the removed region, electrode layers (A1) 10 having a thickness of 0.5 μm are formed by the electron beam evaporation method.

A thin film formed by said layers is subjected to patterning by etching, and on the surface thereof, an insulating layer ($SiO_2$) 11 having a thickness of 1.9 μm and a protective layer (Ta) 12 having a thickness of 0.55 μm are formed by sputtering.

A heat generating portion 13 forming a square having each side of 50 μm is formed by the above-described construction, and the heat generating portion 13 generates heat by a rectangular pulse of voltage 20V and pulse width 10 μsec. being applied between the electrode 10.

FIGS. 3A to 3D show cross-sectional views of an ink jet recording head according to another embodiment of the present invention. In FIGS. 3A to 3D, elements similar to those shown in FIGS. 1A to 1D are given similar reference numerals and need not be described. The construction of FIGS. 3A to 3D differ from the construction shown in FIG. 1 in the location at which the electro-thermal converting member 1 is disposed. That is, in the embodiment shown in FIGS. 1A to 1D, the electro-thermal converting member 1 is provided in the ink liquid chamber, whereas in the present embodiment, the electro-thermal converting member 1 is provided in a nozzle having a discharge port 5. Thereby, the ink discharge response to the input pulse becomes quicker.

In the embodiments shown in FIGS. 1A to 1D and 3A to 3D, the ink liquid is not discharged during the first bubble creation and the subsequent bubble expansion. That is, in the prior art, the ink liquid is discharged at this time and a picture element is formed by the discharged ink droplet to thereby accomplish recording, whereas in the present invention, the head is designed such that an ink droplet is not caused to fly at this time, and in the two embodiments described above, this is realized by making the fluidics impedance great.

The fluidics impedance is an amount determined by the viscosity and mass of the ink liquid or the shapes of the ink liquid chamber, the nozzle and the orifice and further the pressure of the bubble, and is a concept similar to the impedance of an electric circuit.

However, to achieve the objects of the present invention, structure may be provided such that even if an ink droplet is discharged during the first bubble creation, the discharged ink droplet does not form a picture element. As a means for achieving this purpose, for example, a technique of shielding the discharged liquid droplet is disclosed in Japanese Laid-Open Patent Application No. 54-934.

As is apparent from the foregoing description, ink discharge utilizing the pressure when the bubble reaches a maximum volume and thereafter contracts and expands again is effected and therefore, ink discharge in which the movement of the ink liquid is small becomes possible.

Thereby, the discharged ink droplet can be made minute and accordingly, highly dense recording by minute picture elements becomes possible, and images of higher precision can be realized.

I claim:

1. An ink jet recording method characterized in that an electrical signal is input to an electro-thermal converting member to cause heat generation by said electro-thermal converting member to thereby create a bubble in an ink liquid in a first bubble creation, an ink droplet is discharged by pressure when said bubble contracts and expands again in a second bubble creation after the expansion of said bubble has reached a maximum, and the discharged ink droplet is deposited on a recording medium to thereby accomplish recording, so that in a given discharge operation said bubble is formed twice in said first bubble creation and said second bubble creation, and the ink liquid is not discharged in said first bubble creation and is discharged in said second bubble creation.

2. An ink jet recording method according to claim 1, wherein said recording method is effected by using a recording head having a discharge opening provided at a side of an ink liquid chamber opposite the electro-thermal converting member.

3. An ink jet recording method according to claim 2, wherein said discharge opening is located exactly opposite the electro-thermal converting member.

4. An ink jet recording method according to claim 1, wherein said recording method is effected by using a recording head having a discharge opening provided in a nozzle.

5. An ink jet recording method comprising the steps of:

inputting an electrical signal to an electrothermal converting member arranged in a recording head;

creating a bubble in on ink in response to the electrical signal;

expanding the bubble in a first bubble creation to a maximum volume limited by a fluidics impedance determined by at least one specific ink parameter and at least one geometrical dimension of an ink chamber of the recording head including an ink discharge port;

contracting the bubble;

re-expanding the bubble in a second bubble creation due to excessive pressure created in the bubble in the contracting step; and discharging a droplet due to a bulging formed in a meniscus of the ink in the discharge port, so that in a given discharge operation said bubble is formed twice in said first and said second bubble creations, and the ink is not discharged in said first bubble creation and is discharged in said second bubble creation.

6. An ink jet recording method according to claim 5, wherein the electrothermal converting member includes a resistive layer, an electric layer and a protective layer on a surface of the electrothermal converting member that contacts the ink.

7. An ink jet recording method according to claim 5, wherein the electrothermal converting member is provided in an ink path of the recording head.

8. An ink jet recording method according to claim 5, wherein the electrothermal converting member is provided opposed to the ink discharge port.

9. An ink jet recording method according to claim 5, wherein ink is discharged during the re-expanding step.

10. An ink jet recording method according to claim 5, wherein the electrothermal converting member is provided in the ink chamber.

11. An ink jet recording method according to claim 5, wherein the discharge port of the recording head is provided at a side of the ink chamber opposite the electrothermal converting member.

12. An ink jet recording method according to claim 11, wherein the discharge port is located exactly opposite the electrothermal converting member.

13. An ink jet recording method according to claim 5, wherein the discharge port of the recording head is provided in a nozzle.

14. An ink jet recording method for recording on a recording medium by discharging an ink, said method comprising the steps of:

causing an electrothermal converting member to generate heat; and forming a bubble in said ink in a first bubble creation due to the generated heat, and re-expanding the bubble in a second bubble creation, wherein a force generated by re-expanding the bubble in said second bubble creation after shrinkage of the bubble is utilized to discharge the ink to record, so that in a given discharge operation said bubble is formed twice in said first and said second bubble creations, and the ink liquid is not discharged in said first bubble creation and is discharged in said second bubble creation.

15. An ink jet recording method according to claim 14, wherein ink is discharged by utilizing an impacting wave caused by the re-expansion of the bubble.

16. An ink jet recording method according to claim 14, wherein the shrinkage of the bubble occurs after the bubble reaches a maximum volume.

17. An ink jet recording method according to claim 14, wherein the electrothermal converting member generates heat upon reception of a pulse signal.

18. An ink jet recording method according to claim 14, wherein the ink is discharged in the form of a droplet that impacts the recording medium.

19. An ink jet recording method according to claim 14, wherein the electrothermal converting member comprises a resistive layer, an electric layer and a protective layer on a surface of the electrothermal converting member that contacts the ink.

20. An ink jet recording method according to claim 14, wherein the electrothermal converting member is provided in an ink path.

21. An ink jet recording method according to claim 14, wherein the electrothermal converting member is provided opposed to an ink discharge port.

22. An ink jet recording method according to claim 14, wherein ink is discharged during re-expansion of the bubble.

23. An ink jet recording method according to claim 14, wherein the electrothermal converting member is provided in an ink chamber.

24. An ink jet recording method according to claim 14, wherein a recording head is utilized having a discharge opening provided at a side of an ink chamber opposite the electrothermal converting member.

25. An ink jet recording method according to claim 24, wherein the discharge opening is located exactly opposite the electrothermal converting member.

26. An ink jet recording method according to claim 14, wherein a recording head is utilized having a discharge opening provided in a nozzle.

27. An ink jet recording method for recording on a recording medium by discharging an ink, said method comprising the steps of:

causing an electrothermal converting member to generate heat; and generating a bubble in the ink in a first bubble creation, wherein a pressure generated by shrinkage of the bubble and re-expanding the bubble in a second bubble creation after shrinkage of the bubble is utilized to discharge the ink to record, so that in a given discharge operation said bubble is formed twice in said first and said second bubble creations, and the ink liquid is not discharged in said first bubble creation and is discharged in said second bubble creation.

28. An ink jet recording method according to claim 27, wherein the electrothermal converting member includes a resistive layer, an electric layer and a protective layer on a surface of the electrothermal converting member that contacts the ink.

29. An ink jet recording method according to claim 27, wherein the electrothermal converting member is provided in an ink path.

30. An ink jet recording method according to claim 27, wherein the electrothermal converting member is provided opposed to an ink discharge port.

31. An ink jet recording method according to claim 27, wherein ink is discharged during re-expansion of the bubble.

32. An ink jet recording method according to claim 27, wherein the electrothermal converting member is provided in an ink chamber.

33. An ink jet recording method according to claim 27, wherein a recording head is utilized having a discharge opening provided at a side of an ink chamber opposite the electrothermal converting member.

34. An ink jet recording method according to claim 33, wherein the discharge opening is located exactly opposite the electrothermal converting member.

35. An ink jet recording method according to claim 27, wherein a recording head is utilized having a discharge opening provided in a nozzle.

36. A method according to claim 27, wherein ink is discharged by utilizing an impacting wave caused by the re-expansion of the bubble.

37. A method according to claim 27, wherein the shrinkage of the bubble occurs after the bubble reaches a maximum volume.

38. A method according to claim 27, wherein the electrothermal converting member generates heat upon reception of a pulse signal.

39. A method according to claim 27, wherein the ink is discharged in the form of a droplet that impacts the recording medium.

* * * * *

UNITED STATES PATENT AND TRADEMARK OFFICE

CERTIFICATE OF CORRECTION

PATENT NO. : 5,548,312

DATED : August 20, 1996

INVENTOR(S) : AKIRA ASAI

It is certified that error appears in the above-identified patent and that said Letters Patent is hereby corrected as shown below:

On the title page: Item

[30], FOREIGN APPLICATION PRIORITY DATA

"150000" should read --63-150000--.

Item

[73], ASSIGNEE

"Canon Kabusihiki Kaisha" should read --Canon Kabushiki Kaisha--.

Item:

[56], FOREIGN PATENT DOCUMENTS

"0159188 10/1985 European Pat. Off." should be deleted.

Line 27, "on" should read --and--.

Signed and Sealed this

First Day of April, 1997

Bruce Lehman

*Attest:*

BRUCE LEHMAN

*Attesting Officer*

*Commissioner of Patents and Trademarks*